US012791037B2

(12) United States Patent
Gattu et al.

(10) Patent No.: US 12,791,037 B2
(45) Date of Patent: Nov. 10, 2026

(54) IMPELLER

(71) Applicant: Honeywell International Inc., Charlotte, NC (US)

(72) Inventors: Raghavendra Gattu, Bangalore (IN); Bharath Chandra G, Bangalore (IN); Chandiran Jayamurugan, Bangalore (IN); Niall McCabe, Torrance, CA (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 19/210,985

(22) Filed: May 16, 2025

(65) Prior Publication Data

US 2026/0276000 A1 Sep. 17, 2026

(30) Foreign Application Priority Data

Mar. 13, 2025 (IN) ..... 202511022700

(51) Int. Cl.

| | |
|---|---|
| ***F04D 29/42*** | (2006.01) |
| ***F04D 29/28*** | (2006.01) |
| ***F04D 29/30*** | (2006.01) |
| ***F04D 29/44*** | (2006.01) |

(52) U.S. Cl.

CPC ..... *F04D 29/286* (2013.01); *F04D 29/30* (2013.01); *F04D 29/4213* (2013.01); *F04D 29/4246* (2013.01); *F04D 29/441* (2013.01)

(58) Field of Classification Search

CPC .. F04D 29/4213; F04D 29/284; F04D 29/286; F04D 29/4226; F04D 29/441

See application file for complete search history.

(56) References Cited

U.S. PATENT DOCUMENTS

| | | | | |
|---|---|---|---|---|
| 4,212,585 A * | 7/1980 | Swarden | F04D 29/685 415/206 |
| 4,877,373 A | 10/1989 | Bandukwalla | |
| 6,164,911 A * | 12/2000 | LeBlanc | F04D 29/685 415/173.1 |
| 7,338,250 B2 * | 3/2008 | Martindale | F04D 29/526 415/173.1 |
| 10,907,869 B2 | 2/2021 | Hagh et al. | |

(Continued)

FOREIGN PATENT DOCUMENTS

| | | |
|---|---|---|
| JP | H09264296 A | 10/1997 |
| JP | 7001438 B2 | 1/2022 |

OTHER PUBLICATIONS

Extended Search Report from counterpart European Application No. 26159935.1 dated Jul. 17, 2026, 8 pp.

(Continued)

*Primary Examiner* — Michael L Sehn

(74) *Attorney, Agent, or Firm* — Shumaker & Sieffert, P.A.

(57) ABSTRACT

An impeller for a centrifugal compressor configured to compress a fluid. The compressor includes a hub and a shroud surrounding the hub. A plurality of vanes extend from the hub toward the shroud. The impeller is configured to receive the fluid in an eye defined by the hub and the shroud. A shroud inner surface of the shroud defines a plurality of riblets extending in a direction from the shroud inner surface toward an outer surface of the hub. The riblets may extend over the shroud inner surface substantially from the eye to one or more discharges of the impeller.

20 Claims, 5 Drawing Sheets

(56) References Cited

U.S. PATENT DOCUMENTS

| | | | |
|---|---|---|---|
| 11,085,460 | B2 | 8/2021 | Japiske |
| 11,530,708 | B2 | 12/2022 | Hayashi et al. |
| 12,129,859 | B1 | 10/2024 | Gattu et al. |
| 2017/0314576 | A1 | 11/2017 | Jonen |
| 2019/0178255 | A1* | 6/2019 | Leighty ..... F04D 27/002 |
| 2021/0108649 | A1 | 4/2021 | Demory et al. |
| 2021/0285463 | A1 | 9/2021 | Zug et al. |

OTHER PUBLICATIONS

Response to Extended Search Report dated Jul. 17, 2026, from counterpart European Application No. 26159935.1 filed Aug. 13, 2026, 36 pp.

* cited by examiner

IMPELLER

This application claims the benefit of Indian Provisional Patent Application No. 202511022700, filed Mar. 13, 2025, and entitled "IMPELLER," the entire contents of which is incorporated herein by reference.

TECHNICAL FIELD

The present disclosure relates to an impeller configured to receive a fluid, such as an impeller in a centrifugal compressor.

BACKGROUND

Compressors may be used to increase a pressure of a fluid, such as a gas, a liquid, and/or a gas/liquid mixture. In some instances, a compressor may be employed in a vapor cycle system used to provide cooling. The vapor cooling system may utilize the compressor to increase a pressure of a refrigerant carrying heat from a first location (e.g., an internal environment) to cause a condensation of the refrigerant and rejection of the heat at a second location (e.g., an exterior location). In some examples, the compressor may be a centrifugal compressor configured to increase a pressure by imparting a kinetic energy to the fluid.

SUMMARY

In an example, an impeller configured to compress a fluid comprises: a shroud; a hub, wherein the shroud and the hub define an eye configured to receive the fluid and define an outlet configured to discharge the fluid, and wherein the shroud includes a shroud inner surface facing the hub; and at least a first vane and a second vane, the first vane and the second vane extending from the hub and toward the shroud and extending from the eye to the outlet, wherein the shroud inner surface defines a plurality of riblets extending toward the hub, the plurality of riblets extending in a direction from the eye toward the outlet.

In an example, an impeller for a compressor configured to compress a fluid comprises: a shroud; a hub, wherein the shroud and the hub define an eye configured to receive the fluid and define an outlet configured to discharge the fluid, wherein the eye is configured to receive the fluid when the fluid flows in an axial direction and the outlet is configured to discharge the fluid in a radial direction substantially perpendicular to the axial direction, and wherein the shroud includes a shroud inner surface facing the hub; and at least a first vane and a second vane, wherein the first vane and the second vane extend from the hub and toward the shroud inner surface and extend from the eye to the outlet, wherein the first vane and the second vane are affixed to the hub and affixed to the shroud inner surface, and wherein the shroud inner surface defines a plurality of riblets extending toward the hub, the plurality of riblets extending in a direction from the eye toward the outlet.

In an example, a method comprises: receiving, using an impeller, a fluid within an eye of the impeller defined by a shroud of the impeller and a hub of the impeller, wherein the shroud and the hub defines an outlet, wherein the shroud includes a shroud inner surface facing the hub, and wherein the impeller includes at least a first vane and a second vane, the first vane and the second vane extending from the hub and toward the shroud and extending from the eye to the outlet; and discharging, using the impeller, the fluid from the outlet, wherein the shroud inner surface defines a plurality of riblets extending toward the hub, the plurality of riblets defining a plurality of grooves extending in a direction from the eye toward the outlet.

The details of one or more examples are set forth in the accompanying drawings and the description below. Other features, objects, and advantages will be apparent from the description and drawings, and from the claims.

DETAILED DESCRIPTION

Figure 1:
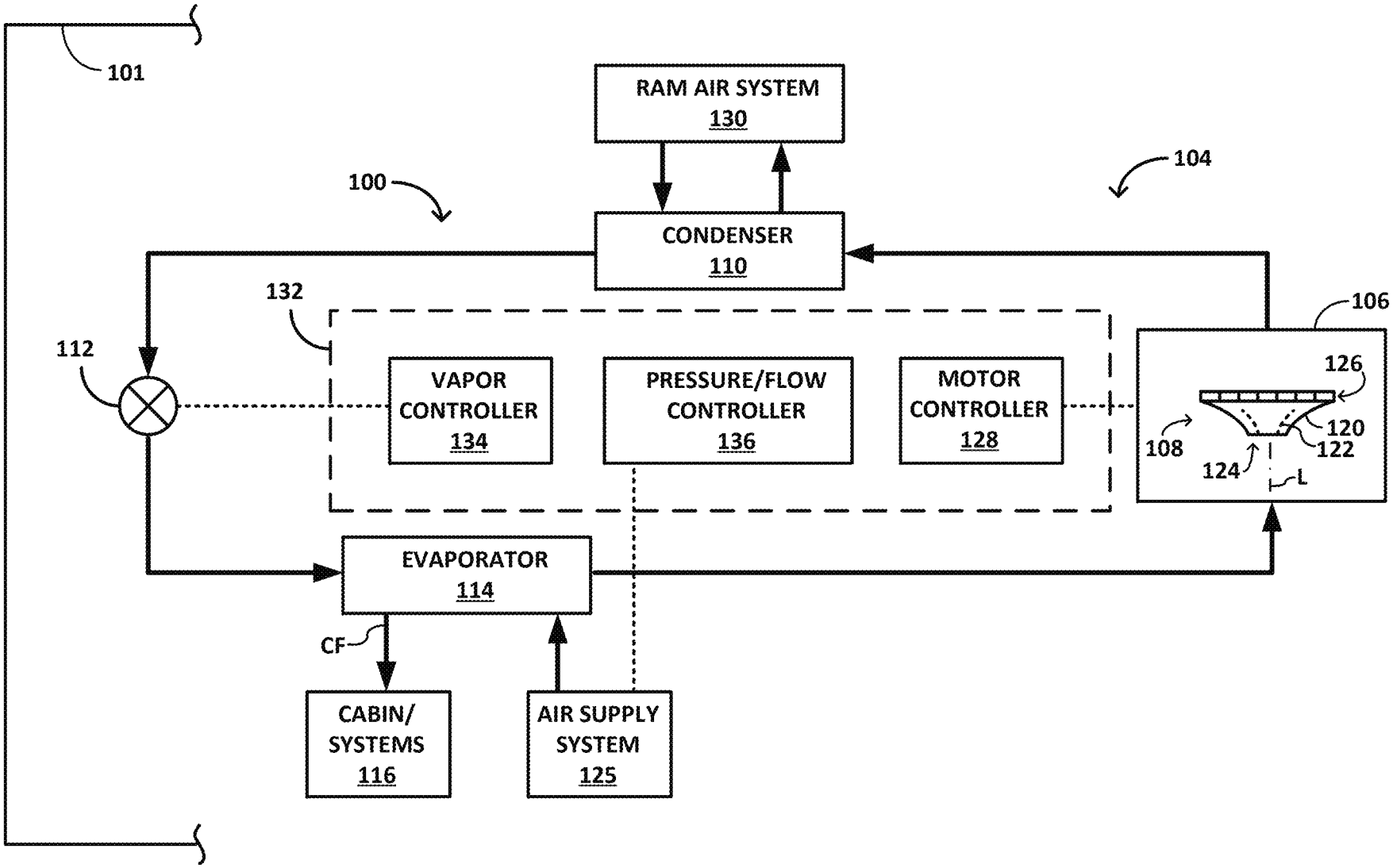
FIG. 1 is a schematic illustration of an example vapor compression system using an impeller of a compressor.

Centrifugal compressors may cause a pressure increase of a fluid by adding energy to a relatively continuous flow of the fluid through an impeller. The impeller may include a central hub and a plurality of vanes extending radially outward from the hub. In examples, the impeller is a shrouded impeller which includes a shroud substantially surrounding the hub and the vanes, such that the shroud substantially covers the vanes as the vanes extend between the hub and the shroud. In some examples, the impeller may be an open impeller wherein the vanes are substantially uncovered. The compressor may be configured to cause rotation of the impeller (e.g., using a motorized shaft), such that the plurality of vanes act to accelerate and impart kinetic energy to the fluid as the fluid passes through the impeller. In some examples, the compressor and/or impeller include a diffuser portion configured to decelerate the fluid and convert the kinetic energy to potential energy to cause an increase in the pressure (e.g., a static pressure) of the fluid. The fluid is typically a gas, a liquid, or a mixture of a gas and a liquid.

In some examples, the compressor may be utilized in a vapor cycle system used to provide cooling. The vapor cycle system may include an evaporator (e.g., a cooling coil) wherein a fluid (e.g., a refrigerant) absorbs heat (e.g., latent heat of vaporization) from a first environment and transitions from a relatively low pressure liquid phase to a vapor phase. The compressor may be configured to receive the vapor from the evaporator and increase its pressure to produce a relatively high pressure vapor phase. The vapor phase may be provided to a condenser, wherein the fluid rejects heat (e.g., latent heat of condensation) to a second environment and transitions from the relatively high pressure vapor phase to the liquid phase. From the condenser, the liquid phase may be expanded (e.g., using a throttling device such as a valve or orifice plate) to reduce its pressure before being returned to the evaporator. Hence, the vapor compression system may be configured to provide cooling to the first environment by altering the thermodynamic state of the fluid (e.g., the temperature and/or pressure) such that the fluid tends to absorb heat from the first environment and reject the heat to the second environment.

The compressor may include an impeller configured to cause the increase in the pressure of the fluid. As the impeller rotates and receives the fluid, the impeller may be configured to accelerate the fluid and add fluid kinetic energy. The fluid may be decelerated in a diffuser, such that at least some portion of the fluid kinetic energy is converted to a fluid potential energy, causing a static pressure increase of the fluid.

In some examples, the impeller may be configured to receive the fluid via an eye (e.g., defined by the hub and the shroud). The impeller may be configured such that the hub, the vanes, and/or the shroud substantially define a plurality of fluid channels, with each individual fluid channel extending substantially from the eye to an individual outlet of the individual fluid channel. As the impeller rotates and receives the fluid, the impeller accelerates the fluid through each of the fluid channels and ejects the fluid from the individual outlets, such that the impeller imparts the fluid kinetic energy. In examples, the impeller is configured to receive the fluid via the eye in an axial direction and discharge the fluid via the outlets in a direction substantially perpendicular to the axial direction.

The acceleration of the fluid through the impeller may give rise to complex flow patterns within the fluid channels. In some cases, the flow patterns may produce pressure fluctuations, flow reversals, and/or other unsteady flow phenomena within one or more fluid channels, such as along an inner surface of the shroud defining a boundary of the fluid channel. Such pressure fluctuations, flow reversals, and/or other unsteady flow phenomena may act to decrease the compression efficiency of the compressor, which may act to increase the amount of energy (e.g., electrical energy) which must be provided to the compressor motor in order to increase the pressure of the fluid to that desired elsewhere in a system (e.g., desired in a condenser). For example, a control system may be configured to control a rotational speed of the impeller in order to control the pressure increase of the fluid. The pressure fluctuations, flow reversals, and/or other unsteady flow phenomena within a fluid channel of the impeller may tend to detract from the pressure increase, such that controller tends to command a higher speed requiring greater electrical energy than might otherwise be required in the absence or reduction of the pressure fluctuations, flow reversals, and/or other unsteady flow phenomena. Hence, mitigating the pressure fluctuations, flow reversals, and/or other unsteady flow phenomena within the impeller may act to decrease the electrical energy consumed by the compressor, potentially leading to increases in compressor efficiency.

Disclosed herein is an impeller for a compressor configured to accelerate a fluid to cause an increased pressure of the fluid. The impeller includes a hub and a plurality of vanes affixed to and extending radially outward from the hub. The impeller includes a shroud substantially surrounding the hub and the vanes. In examples, the vanes are affixed to the shroud, such that the hub, the vanes, and the shroud remain stationary relative to each other when the impeller rotates about an axis (e.g., the impeller may be a closed impeller). The hub and the shroud define an eye configured to receive a fluid (e.g., a vapor). The impeller is configured to increase a velocity of the fluid and discharge the fluid through one or more outlets as the impeller rotates about the axis and receives the fluid via the eye.

An inner surface of the shroud ("shroud inner surface") defines a plurality of riblets extending from the shroud inner surface toward the hub. The plurality of riblets may act to reduce and/or mitigate pressure fluctuations, flow reversals, and/or other unsteady flow phenomena within a fluid channel of the impeller as the impeller increases the velocity of the fluid. Hence, the plurality of riblets may enable a decrease in the electrical energy consumed by the compressor as compared to an impeller without the riblets, and thereby enable an increase in compressor efficiency.

The impeller may define a plurality of fluid channels extending from the eye to the one or more outlets. For example, the shroud may be configured such that the shroud inner surface substantially faces an outer surface of the hub ("hub outer surface") as the shroud surrounds the hub. At least a first vane and a second vane of the plurality of vanes may extend from the hub outer surface to the shroud inner surface. The first vane, the second vane, a portion of the shroud inner surface between the first vane and the second vane, and a portion of the hub outer surface between the first vane and the second vane may define a boundary around a fluid channel which extends substantially from the eye to an outlet. The impeller may be configured such that some portion of the fluid received by the eye flows through the fluid channel as the rotational action of the impeller accelerates the portion of the fluid. The plurality of riblets defined by the portion of the shroud inner surface between the first vane and the second vane may act to reduce and/or mitigate pressure fluctuations, flow reversals, and/or other unsteady flow phenomena within the fluid channel as the impeller increases the velocity of the fluid, thereby enabling an increase in compressor efficiency.

In examples, the plurality of riblets define a plurality of grooves extending in a direction from the eye toward the one or more outlets. The plurality of riblets may be configured such that the plurality of grooves are nonintersecting as the grooves extend in the direction from the eye toward the one of more outlets. For example, the inner shroud surface may define a plurality of lines of curvature extending from the eye to the outlet of the fluid channel, with each line of curvature being non-intersecting with any other line of curvature. A riblet in the plurality of riblets may be configured to substantially follow a given line of curvature, such that the grooves defined therebetween are substantially nonintersecting as the riblets and the grooves extend in the direction from the eye to the outlet of the fluid channel. In examples, the riblets and/or grooves are configured to assist in maintaining fluid streamlines in proximity to the shroud inner surface to reduce and/or mitigate pressure fluctuations, flow reversals, and/or other unsteady flow phenomena.

In examples, the impeller is an impeller for a centrifugal compressor configured to compress a refrigerant in a vapor compression system. In some examples, the vapor compression system is configured to cool pressurized air provided to a pressurized cabin and/or avionics system of a vehicle such as an aircraft. In some examples, the vapor compression system may be configured to cool a cooling liquid (e.g., water) provided to equipment of the vehicle and/or configured to provide direct contact-cooling to the equipment. The riblets of the impeller may enable an increase in the efficiency of the compressor and the vapor compression system, and thereby enable an increase in the fuel and/or energy efficiency of the vehicle.

As an example, FIG. 1 illustrates a schematic block diagram of an example system 100 configured to provide a cooled fluid CF (e.g., air) for cooling of spaces and/or equipment. In examples, system 100 is configured to provide cooled fluid CF to spaces and/or equipment defined and/or supported by a vehicle 101. For example, cooled fluid CF may be used to cool volumes or components of various cabins or systems of vehicle 101 ("cabin/systems 116"). Cabin/systems 116 may include a compartment of vehicle 101 (e.g., an aircraft, an automobile, a spacecraft, a watercraft, etc.) that includes an internal environment, and/or be one or more electronic, electrical, and or mechanical systems of vehicle 101 configured to receive cooled fluid CF. Note that, while system 100 is generally described as a portion of vehicle 101 for illustration, this is not required in other examples.

System 100 may include a vapor cooling system 104 ("VCS 104"). VCS 104 may include a compressor 106 including an impeller 108, a condenser 110, an expansion device 112 (e.g., an expansion valve), and an evaporator 114. Evaporator 114, compressor 106, condenser 110, and expansion device 112 may be fluidically coupled to form a refrigerant circuit configured to transfer heat from cabin/systems 116 to a system in thermal communication with condenser 110, such as a ram air system 130.

In examples, evaporator 114 is configured to cause a transfer of heat to the refrigerant from an environment or component in thermal communication with evaporator 114 (e.g., a cooling coil of evaporator 114). Evaporator 114 may be configured to cause the refrigerant to transition from a liquid phase to a vapor phase when evaporator 114 transfers the heat, such that the refrigerant substantially absorbs the heat transferred as latent heat. VCS 104 may be configured to transfer the refrigerant substantially in a vapor phase from evaporator 114 to compressor 106.

Compressor 106 may be configured to receive the vapor phase refrigerant from evaporator 114 and compress the vapor phase refrigerant. For example, compressor 106 may be configured to receive the vapor phase refrigerant at an inlet pressure and compress the vapor phase refrigerant to an outlet pressure greater than the inlet pressure. In examples, compressor 106 is a centrifugal compressor configured to compress the vapor phase refrigerant using impeller 108. Impeller 108 may be configured to accelerate the received vapor phase refrigerant (e.g., by rotation of impeller 108 about an axis L) to add a fluid kinetic energy to the vapor phase refrigerant. Compressor 106 may be configured to decelerate the vapor phase refrigerant to convert at least some portion of the fluid kinetic energy to a fluid potential energy, resulting in an increase in the static pressure of the vapor phase refrigerant. The compression by compressor 106 may also cause an increase in the temperature of the vapor phase refrigerant.

In examples, impeller 108 includes a shroud 120 substantially surrounding a hub 122. Hub 122 is depicted with dashed lines in FIG. 1. Shroud 120 and/or hub 122 may define an eye 124 of impeller 108. In examples, impeller 108 is configured to accelerate the vapor phase refrigerant and discharge the increased pressure vapor phase refrigerant via one or more of a plurality of outlets 126 ("outlets 126"). In examples, impeller 108 includes a plurality of vanes (e.g., vanes 138 (FIG. 2)) extending from hub 122 toward shroud 120 and configured to accelerate the vapor phase refrigerant as the vapor phase refrigerant flows from eye 124 to outlets 126. Impeller 108 may be configured such that hub 122, the plurality of vanes, and/or shroud 120 substantially define a plurality of fluid channels, with each fluid channel extending substantially from eye 124 to an individual outlet of outlets 126. In examples, impeller 108 is configured to receive the vapor phase refrigerant via eye 124 in an axial direction substantially parallel to axis L and discharge the vapor phase refrigerant in a direction substantially perpendicular to axis L.

A shroud inner surface of shroud 120 (e.g., shroud inner surface 152 (FIG. 2)) substantially faces hub 122 and defines a plurality of riblets (e.g., riblets 154 (FIG. 2)) which extend from the shroud inner surface toward hub 122. In examples, the plurality of riblets define a plurality of grooves extending in a direction from eye 124 toward an outlet of outlets 126. The plurality of riblets and/or plurality of groves may act to reduce and/or mitigate pressure fluctuations, flow reversals, and/or other unsteady flow phenomena within the fluid channels of impeller 108 as impeller 108 increases the velocity of the vapor phase refrigerant. Hence, the plurality of riblets and/or plurality of groves may enable an increase in the compressor efficiency of compressor 106, as compared to compressors where such surface features may be absent.

Compressor 106 may include one or more compression stages (e.g., one or more impellers) and an electrically driven motor. The motor may be configured to receive electrical power, such as from a motor controller 128, and generate mechanical power to drive the one or more compression stages. In examples, compressor 106 may be configured to provide cooling to various components of the compressor using the vapor refrigerant as a cooling medium. For example, a compressor motor, shaft bearings, and other components of compressor 106 which receive electrical and/or mechanical power and/or experience friction may produce heat that needs to be removed. Rather than remove this heat using external cooling, which may be heavy or inefficient to operate, compressor 106 may use the vapor refrigerant (e.g., portion of the vapor refrigerant entering eye 124) to cool various components of compressor 106, thereby reducing or eliminating systems and/or requirements for the provision of external cooling to compressor 106.

Condenser 110 may be configured to receive the substantially vapor refrigerant from compressor 106 and condense the vapor refrigerant to a condensed refrigerant (e.g., a liquid or a liquid/vapor mixture). In some examples, condenser 110 may be cooled by environmental air, such as ram air flow from a ram air system 130, or another fluid such as fuel or heat transport fluids. Condenser 110 may be configured to transfer beat to ram air system 130 as the vapor refrigerant condenses to the condensed refrigerant (e.g., transfer latent heat of condensation), such that VCS 104 substantially transfers heat from a first environment in thermal communication with evaporator 114 to a second environment in thermal communication with condenser 110.

VCS 104 may be configured such that condenser 110 substantially provides (e.g., discharges) the condensed refrigerant to expansion device 112. Expansion device 112 may be configured to control a flow of the condensed refrigerant (e.g., from condenser 110 to evaporator 114) and reduce a pressure of the condensed refrigerant prior to entry into evaporator 114. Expansion device 112 may be an orifice, tube, metered valve, or other device configured to reduce a pressure of the condensed refrigerant.

In examples, system 100 includes a control system 132 for controlling various conditions of VCS 104, such as refrigerant flow rate, refrigerant vapor composition, refrigerant temperature, and the like. Control system 132 may be configured to monitor and/or operate one or more process control components of system 100. For example, control system 132 may be communicatively coupled to any of an air supply system 125, ram air system 130, compressor 106, expansion device 112, or any other component of system 100. Control system 132 may also be communicatively coupled to instrumentation, such as flow meters, temperature sensors, and pressure sensors, and configured to receive measurement signals from the instrumentation. For example, control system 132 may be configured to receive measurement signals for various parameters of VCS 104, such as a speed of compressor 106, a temperature of cabin air leaving evaporator 114, or a superheat of vapor refrigerant entering compressor 106, determine a mismatch between the measurement signals and a setpoint for the corresponding parameter, and send a control signal to one or more components of system 100 to reduce the mismatch and return the parameter to within the setpoint. Control system 132 may include any of a wide range of devices, including processors (e.g., one or more microprocessors, one or more application specific integrated circuits (ASICs), one or more field programmable gate arrays (FPGAs), or the like), servers, desktop computers, notebook (i.e., laptop) computers, tablet computers, and the like.

Control system 132 (e.g., motor controller 128) may be configured to control a motor of compressor 106 (e.g., a motor providing mechanical power to impeller 108 and/or other compression stages of compressor 106). Control system 132 may control (e.g., modulate) a flow rate of refrigerant through VCS 104 (e.g., using motor controller 128). In examples, control system 132 is configured to control a speed (e.g., one or more rotational speeds) of compressor 106 (e.g., using motor controller 128). The speed of compressor 106 may correspond to various temperature setpoints of VCS 104, such as cooling demands of evaporator 114 and inlet superheat of the vapor refrigerant into compressor 106. To control the speed of compressor 106, motor controller 128 may be configured to send control signals to compressor 106 to control an amount of electrical power to the motor of compressor 106, such as from an APU or other power supply.

In some examples, control system 132 may include a vapor controller 134 configured to control a vapor composition of the refrigerant in VCS 104, To control a vapor composition of the refrigerant, vapor controller 134 may be configured to send control signals to expansion device 112 and/or evaporator 114 to control a position of expansion device 112 and/or a position of a bypass valve of evaporator 114. For example, vapor controller 134 may be configured to cause expansion device 112 to reduce a flow of the condensed refrigerant (e.g., to move in a closing direction) to increase a superheat of the refrigerant entering compressor 106, and/or cause expansion device 112 to increase a flow of the condensed refrigerant (e.g., to move in an opening direction) to decrease a superheat of the refrigerant entering compressor 106.

In examples, control system 132 includes a pressure/flow controller 136 configured to control pressure and/or flow of supply air to evaporator 114. In some examples, pressure/flow controller 136 may be configured to control air supply system 125 to generate a particular flow of supply air from air supply system 125. For example, pressure/flow controller 136 may be configured to send control signals to air supply system 125 to control a pressure of supply air, such as by controlling an amount of bleed air or a speed of a load compressor (via an APU) or cabin air compressor. In some examples, pressure/flow controller 136 may be configured to control ram air system 130 in order to receive a particular flow of supply air from ram air system 130.

Figure 2:
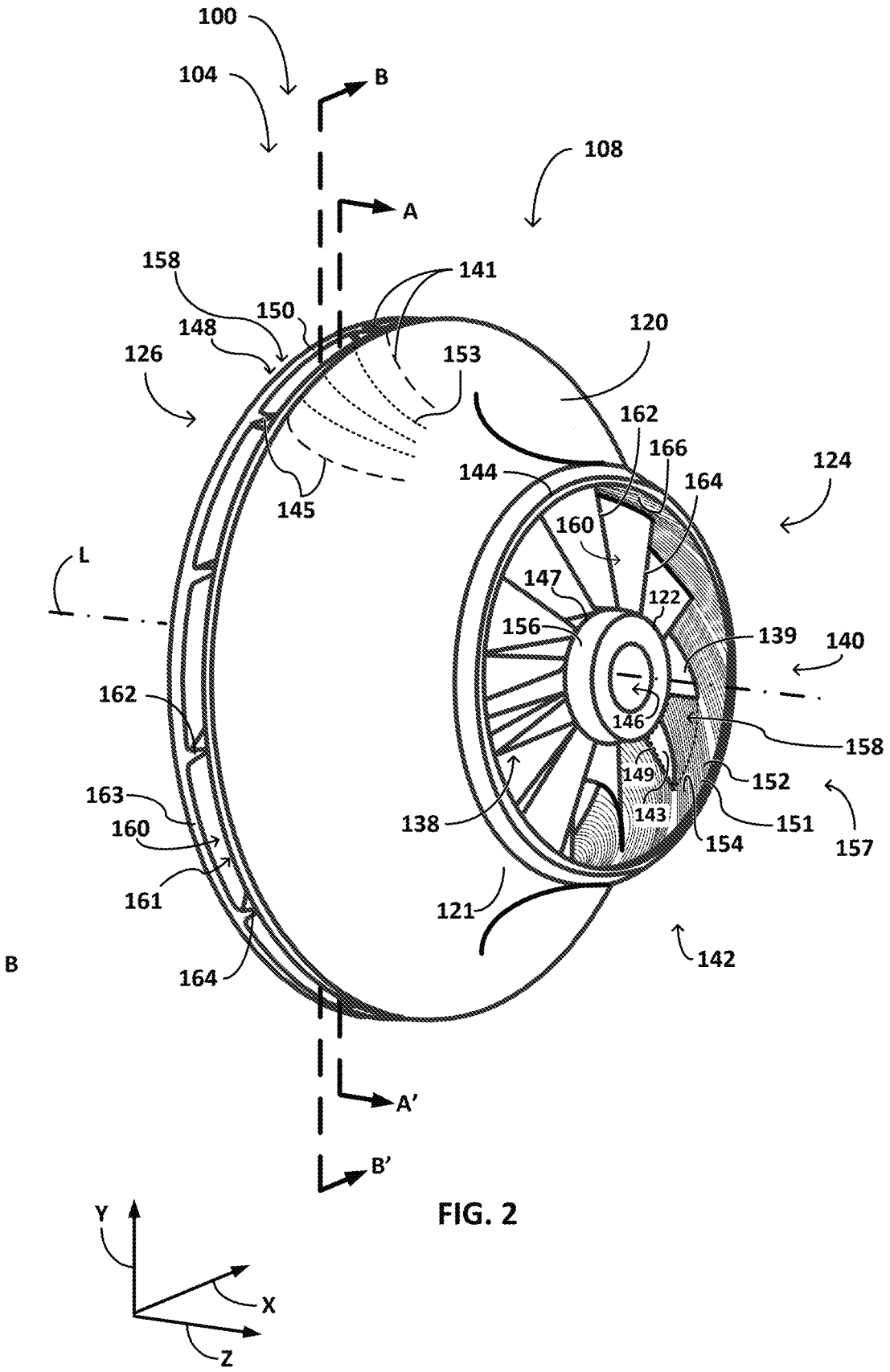
FIG. 2 is a perspective view of an example impeller.

FIG. 2 is a perspective view of an example impeller 108 configured to receive an increase a pressure of a fluid, illustrated in accordance with the X-Y-Z axes shown. Impeller 108 includes hub 122 and shroud 120 defining eye 124. Impeller 108 includes a plurality of vanes 138 ("vanes 138") that include at least a first vane 140 and a second vane 142. In examples, first vane 140 extends from an entry portion 139 ("first vane entry portion 139") in proximity to eye 124 to an outlet portion 141 ("first vane outlet portion 143") in proximity to outlets 126. Second vane 142 may extend from an entry portion 143 ("second vane entry portion 143") in proximity to eye 124 to an outlet portion 145 ("second vane outlet portion 145") in proximity to outlets 126. Impeller 108 is configured to receive a fluid via eye 124 and accelerate the fluid using vanes 138 as impeller 108 rotates about axis L and the fluid flows from eye 124 to outlets 126. Impeller 108 is configured to discharge the fluid received from outlets 126. For example, impeller 108 may be configured to discharge a portion of the fluid received via eye 124 from an outlet opening 148 defined by an outlet 150 of impeller 108.

Impeller 108 may define axis L. In some examples, axis L extends through and/or is surrounded by hub 122. For example, in some examples, hub 122 may define a hub channel 146 defined by a body 147 of hub 122 ("hub body 147"). Hub channel 146 may extend through hub body 147, although this is not required. In examples, axis L extends through hub channel 146. Shroud 120 (e.g., body 121 of shroud 120 ("shroud body 121")) may define a front rim 144 substantially surrounding axis L and/or some portion of hub body 147. In examples, eye 124 is an opening defined between front rim 144 and hub body 147. For example, eye 124 may be a substantially annular-shaped opening defined between front rim 144 and hub body 147. In examples, hub channel 146 is configured to receive a shaft of a motor (e.g., shaft 168 (FIG. 3B)). Hub body 147 may be configured to receive a torque around axis L (e.g., from the shaft) to cause rotation of hub body 147 and vanes 138 about axis L. In examples, impeller 108 is configured such that shroud body 121, hub body 147, and vanes 138 rotate about axis L when hub body 147 receives the torque (e.g., shroud 120, hub body 147, and vanes 138 are configured to remain stationary relative to each other when hub body 147 receives the torque).

Shroud 120 defines an inner surface 152 ("shroud inner surface 152") facing toward hub 122. In examples, shroud body 121 defines shroud inner surface 152. Shroud inner surface 152 defines a plurality of riblets 154 ("riblets 154") extending in a direction from shroud inner surface 152 toward hub 122. In examples, hub body 147 defines an outer surface 156 ("hub outer surface 156") facing shroud inner surface 152. Shroud inner surface 152 may be configured such that riblets 154 extend substantially in a direction from shroud inner surface 152 toward hub outer surface 156. Riblets 154 may extend substantially from eye 124 to outlets 126 to, for example, act to reduce and/or mitigate pressure fluctuations, flow reversals, and/or other unsteady flow phenomena within a fluid channel of impeller 108 as impeller 108 accelerates fluid received via eye 124 through the fluid channel.

For example, impeller 108 may define a plurality of fluid channels 157 ("channels 157") extending substantially from eye 124 to outlets 126, such as a fluid channel 158 extending substantially from eye 124 to outlet opening 148 of outlet 150. In examples, fluid channel 158 is a fluid channel which passes between first vane 140 and second vane 142. For example, first vane 140 may extend substantially from hub 122 to shroud inner surface 152 as first vane 140 extends from first vane entry portion 139 to first vane outlet portion 141. Second vane 142 may extend substantially from hub 122 to shroud inner surface 152 as second vane 142 extends from second vane entry portion 143 to second vane outlet portion 145.

First vane 140, second vane 142, a portion of shroud inner surface 152 between first vane 140 and second vane 142, and a portion of hub outer surface 156 between first vane 140 and second vane 142 may define a boundary around fluid channel 158. In examples, first vane 140, second vane 142, a portion of shroud inner surface 152 between first vane 140 and second vane 142, and a portion of hub outer surface 156 between first vane 140 and second vane 142 define a channel inlet 149 configured to receive at least a portion of the fluid received by eye 124. Fluid channel 158 may extend at least from channel inlet 149 to outlet 150. In examples, the boundary defined around fluid channel 158 extends substantially from channel inlet 149 to outlet opening 148.

Impeller 108 may be configured such that shroud inner surface 152 defines riblets 154 over at least some portion of shroud inner surface 152 between first vane 140 and second vane 142. In examples, at least some portion of riblets 154 extend through fluid channel 158 substantially from eye 124 to outlet 150. For example, a portion of riblets 154 may extend from an entry portion 151 of riblets 154 ("riblets entry portion 151") to an outlet portion 153 of riblets 154 ("riblets outlet portion 153"). Riblets entry portion 151 may be defined by shroud inner surface 152 substantially between first vane entry portion 139 and second vane entry portion 143. Riblets outlet portion 153 may be defined by shroud inner surface 152 substantially between first vane outlet portion 141 and second vane outlet portion 145. Hence, impeller 108 may be configured such that riblets 154 extend between first vane 140 and second vane 142 over at least some portion of shroud inner surface 152 defining fluid channel 158 as fluid channel 158 extends between eye 124 and outlet opening 148. In FIG. 2, a portion of first vane outlet portion 141. A portion of second vane outlet portion 145, and riblets outlet portion 153 are hidden "behind" shroud 120 (e.g., shroud body 121) and depicted as dashed lines.

Channels 158 may comprise a plurality of fluid channels extending substantially from eye 124 to an outlet of outlets 126. For example, in addition to fluid channel 158 extending between first vane 140 and second vane 142, impeller 108 may define one or more additional fluid channels such as fluid channel 160 extending substantially between a third vane 162 and a fourth vane 164 of vanes 138. Fluid channel 160 may extend from eye 124 to an outlet opening 161 defined by an outlet 163 of outlets 126. In examples, third vane 162, fourth vane 164, a portion of shroud inner surface 152 extending between third vane 162 and fourth vane 164, and a portion of hub outer surface 156 extending between third vane 162 and fourth vane 164 define a boundary of fluid channel 160. In examples, impeller 108 is configured to receive a fluid in eye 124, cause a first portion of the fluid to flow into fluid channel 158 and discharge via outlet opening 148, and cause a second portion of the fluid to flow into fluid channel 160 and discharge via outlet opening 161. Impeller 108 may include any number of vanes (e.g., configured similarly to first vane 140, second vane 142, third vane 162, and/or fourth vane 164) in vanes 138. Vanes 138, shroud inner surface 152, and hub outer surface 156 may define any number of fluid channels (e.g., configured similarly to fluid channel 158 and/or fluid channel 160).

Shroud inner surface 152 may define riblets configured similarly to riblets 154 within any fluid channel. For example, a portion of shroud inner surface 152 between third vane 162 and fourth vane 164 may define a second plurality of riblets 166 ("second riblets 166") extending in a direction from shroud inner surface 152 toward hub outer surface 156. Second riblets 166 may extend substantially from eye 124 to outlets 163 to, for example, act to reduce and/or mitigate pressure fluctuations, flow reversals, and/or other unsteady flow phenomena within fluid channel 160 as impeller 108 accelerates fluid received via eye 124 through fluid channel 160. Shroud inner surface 152 may define riblets configured similarly to riblets 154 and/or second riblets 166 in any of channels 157 defined by impeller 108. In examples, shroud inner surface 152 defines riblets configured similarly to riblets 154 and/or second riblets 166 in each fluid channel of channels 157.

Further, although riblets 154 are described as being largely defined by shroud inner surface 152 in the examples herein, other portions of impeller 108 (e.g., one or more of vanes 138 such as first vane 140, second vane 142, third vane 162, and/or fourth vane 164, and/or some portion of hub 122 such as hub body 147 and/or hub outer surface 156) may define riblets configured similarly to riblets 154 in addition to or instead of impeller 108.

Figure 3B:
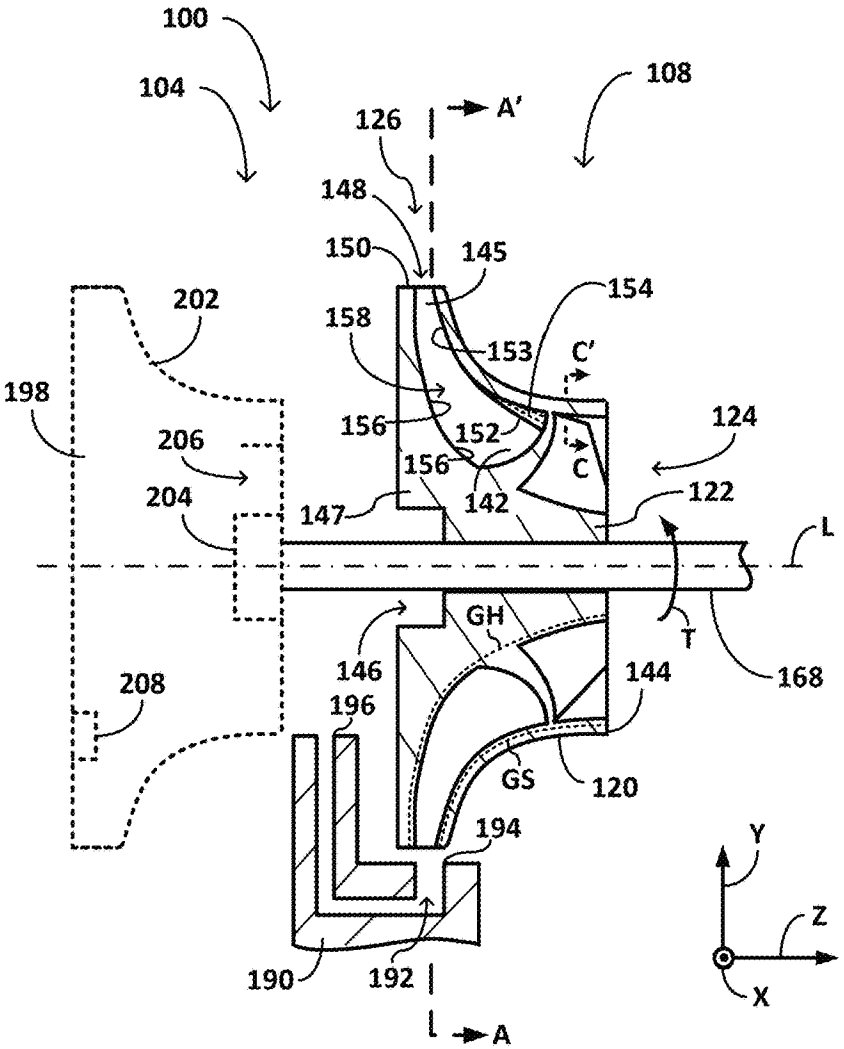
FIG. 3B is a cross-sectional side view of the example impeller of FIG. 3A and portions of a compressor, the cross-section taken with a cutting plane parallel to the page.
Figure 3A:
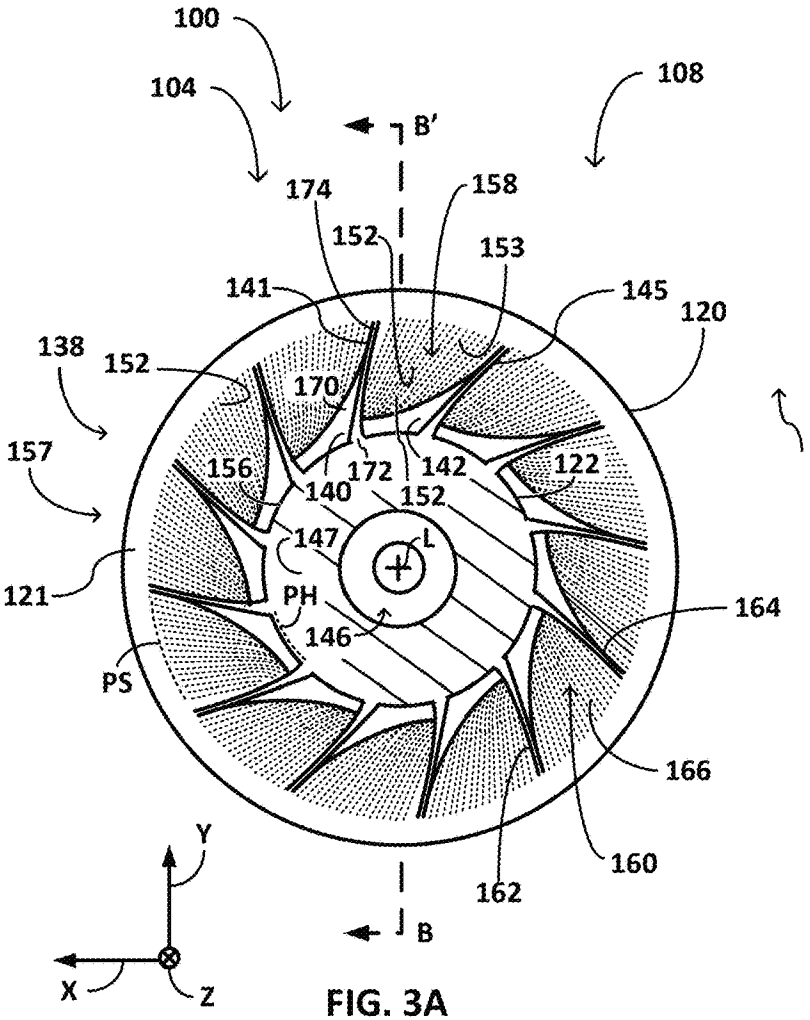
FIG. 3A is a cross-sectional end view of an example impeller, the cross-section taken with a cutting plane parallel to the page.
Figure 4:
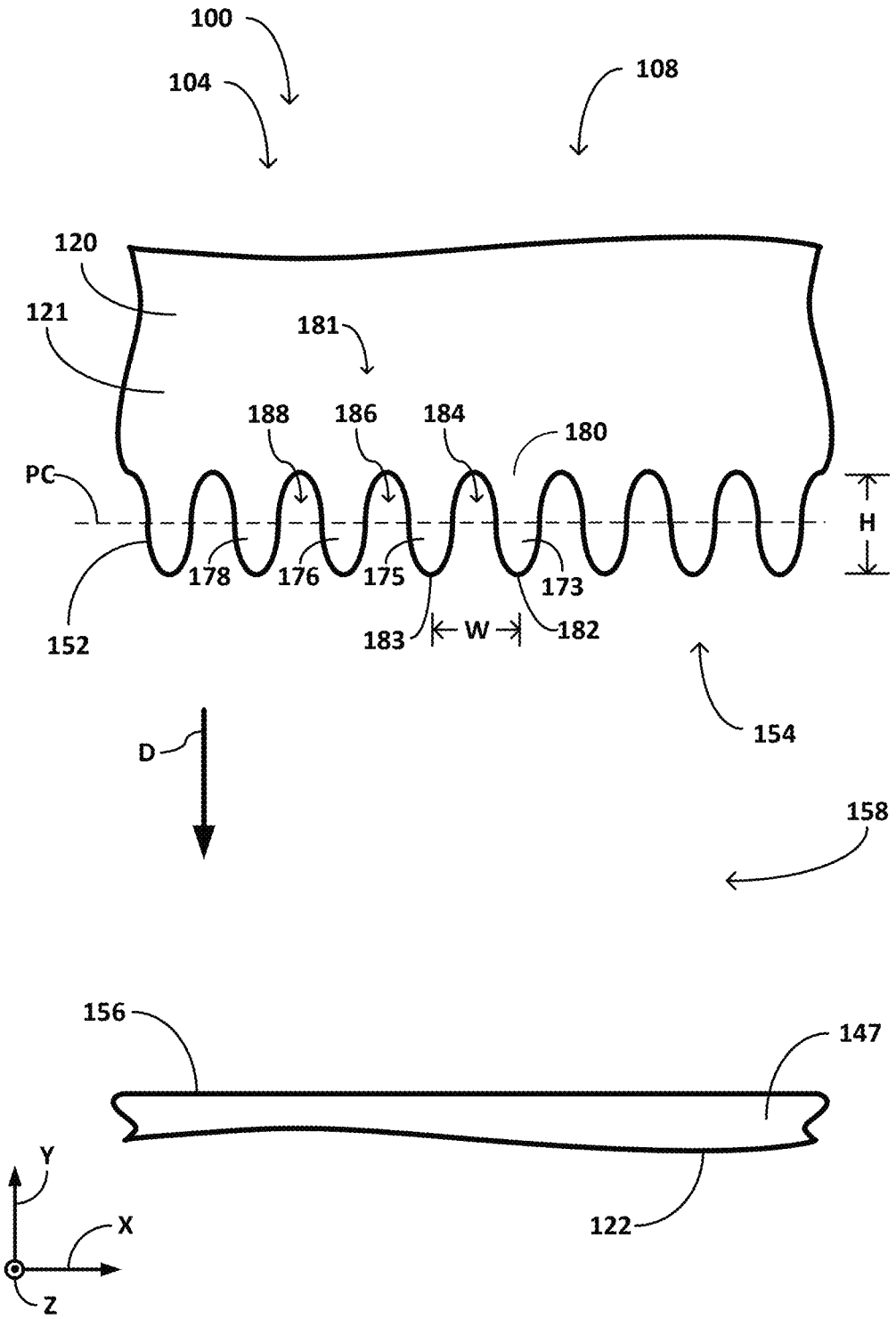
FIG. 4 is a cross-sectional end view of a plurality of riblets, the cross-section taken with a cutting plane parallel to the page.

FIG. 3A is a cross-sectional rear view of impeller 108 illustrated in accordance with the X-Y-Z axes, with the Z axis proceeding into the page, and the cross-section taken through a cutting plane A-A' (FIG. 1 and FIG. 3B) parallel to the X-Y plane. FIG. 3B is a cross-sectional side view of impeller 108 illustrated in accordance with the X-Y-Z axes, with the X axis proceeding out of the page, and the cross-section taken through a cutting plane B-B' (FIG. 1 and FIG. 3A) parallel to the Y-Z plane. FIG. 4 is a schematic cross-sectional view of a portion of riblets 154 illustrated in accordance with the X-Y-Z axes, with the Z axis proceeding out of the page, and the cross-section taken through a cutting plane C-C' (FIG. 3B) parallel to the X-Y plane.

One or more of vanes 138 may extend substantially radially outward from hub body 147 toward shroud 120. For example, first vane 140 may extend outward from hub body 147 (e.g., hub outer surface 156) toward shroud body 121 (e.g., shroud inner surface 152). In examples, first vane 140 is affixed to and/or unified with hub body 147. In some examples, first vane 140 is affixed to and/or unified with shroud body 121. For example, first vane 140 may include a body 170 ("vane body 170") defining a first end portion 172 and a second end portion 174 displaced from first end portion 172. First end portion 172 may be affixed to and/or unified with hub body 147 (e.g., hub outer surface 156). Second end portion 174 may be affixed to and/or unified with shroud body 121 (e.g., shroud inner surface 152). In examples, first end portion 172 extends from first vane entry portion 139 (FIG. 2) to first vane outlet portion 141. Second end portion 174 may extend from first vane entry portion 139 to first vane outlet portion 141. Second end portion 174 may be displaced radially outward from first end portion 172 (e.g., second end portion 174 may be displaced from first end portion 172 by a vector within the X-Y plane, the vector originating at hub outer surface 156, the vector having a direction toward shroud inner surface 152, and the vector being non-intersecting with hub body 147).

Shroud body 121 may substantially surround hub body 147. In examples, shroud body 121 may configured such that shroud inner surface 152 is displaced from hub outer surface 156 by vanes 138 at least from eye 124 to outlets 126. For example, impeller 108 may be configured such that first vane 140 displaces shroud inner surface 152 from hub outer surface 156 substantially from first vane entry portion 139 (FIG. 2) to first vane outlet portion 141. In some examples, shroud inner surface 152 defines a shroud perimeter PS in a plane parallel to the X-Y plane of FIG. 3A and hub outer surface 156 defines a hub perimeter PH in the plane parallel to the X-Y plane of FIG. 3A (hub perimeter PH is depicted as slightly displaced from hub outer surface 156 in FIG. 3A for clarity). Impeller 108 may be configured such that shroud perimeter PS surrounds hub perimeter PH. Although depicted as segments in FIG. 3A, shroud perimeter PS and hub perimeter PH may be closed perimeters which surround axis L. Impeller 108 may be configured such that shroud perimeter PS surrounds hub perimeter PH at least from eye 124 to outlets 126.

In some examples, shroud inner surface 152 and/or hub outer surface 156 may substantially define a surface of revolution about axis L. For example, shroud inner surface 152 may be substantially defined by a shroud generatrix GS (FIG. 3B) rotated about axis L Hub outer surface 156 may be substantially defined by a hub generatrix GH rotated about axis L. Shroud generatrix GS is depicted as slightly displaced from shroud inner surface 152 and hub generatrix GH is depicted as slightly displaced from hub outer surface 156 in FIG. 3B for clarity. Shroud generatrix GS and/or hub generatrix GH may extend substantially from eye 124 to outlets 126. In examples, shroud generatrix GS and hub generatrix GH are non-intersecting generatrixes. In some examples, shroud inner surface 152 and/or hub outer surface 156 are substantially bell-shaped surfaces, although this is not required.

Referring largely to FIG. 3B, hub channel 146 may be configured to receive a shaft 168. Hub channel 146 may be configured to receive a torque T (e.g., around axis L) to cause rotation of hub body 147 and vanes 138 about axis L. In examples, motor controller 128 includes a motor configured to impart torque T to shaft 168. VCS 104 may be configured to control the magnitude of torque T using motor controller 128. Hub channel 146 may be configured to transfer torque T to hub body 147 to cause rotation of hub 122, vanes 138, and/or shroud 120 about axis L.

In examples, impeller 108 (e.g., hub 122, vanes 138, and/or shroud 120) is configured to rotate about axis L relative to a housing 190 of compressor 106 (FIG. 1). Housing 190 may be configured to mechanically support impeller 108 and/or shaft 168. In examples, housing 190 defines a channel 192 ("housing channel 192") defining an inlet 194 ("housing inlet 194") fluidically coupled with one or more of outlets 126. Housing channel 192 may be configured to receive fluid discharging from the one or more of outlets 126 and direct the fluid to an outlet 196 defined by housing 190 ("housing outlet 196"). In some examples, compressor 106 includes a second impeller 198 which includes a second shroud 202 and a second hub 204 defining a second eye 206. Housing outlet 196 may be fluidically coupled to second eye 206. Second impeller 198 may be configured to receive fluid discharged from housing outlet 196 and discharge the fluid from one or more outlets of second impeller 198 such as outlet 208.

In examples, second impeller 198 is configured to rotate relative to housing 190 (e.g., as impeller 108 rotates relative to housing 190). Second impeller 198 may be configured receive some portion of torque T from shaft 168 to cause second impeller to rotate (e.g., about axis L) relative to housing 190. For example, impeller 108 may be configured to receive a first portion of torque T to cause rotation of impeller 108 relative to housing 190 and second impeller 198 may be configured to receive a second portion of torque T to cause rotation of second impeller 198 relative to housing 190. Hence, in some examples, compressor 106 may be a multi-stage compressor defining a plurality of compression stages. Compressor 106 may define any number of compression stages.

Referring largely to FIG. 4, which is a cross-section taken through cutting plane C-C' of FIG. 3B, riblets 154 may include riblets such as a first riblet 173 and a second riblet 175. Shroud inner surface 152 may define any number of riblets configured similarly to first riblet 173 and/or second riblet 175, such as a third riblet 176, a fourth riblet 178, and so on. Riblets 173, 175, 176, 178 extend in a direction D from shroud inner surface 152 toward hub outer surface 156. For example, first riblet 173 may define a first end 180 ("riblet first end 180") affixed to or continuous with shroud body 121 and a second end 182 ("riblet second end 182") substantially opposite riblet first end 180. Second end 182 may be displaced from first end 180 in the direction D. In examples, second end 182 may be displaced from first end 180 by a height H in the direction D. In some examples, height H is less than about 5 millimeters (mm), in some examples less than about 1 mm, and in some examples less than about 0.5 mm. Riblet 175, 176, 178 and other riblets of riblets 154 may be configured similarly to first riblet 173.

Riblets 154 may be configured to define a plurality of grooves 181 ("grooves 181"). In examples, each groove is defined between a riblet and an adjacent riblet of riblets 154. For example, grooves 181 may include a first groove 184 defined between first riblet 173 and second riblet 175, a second groove 186 defined between second riblet 175 and third riblet 176, a third groove 188 defined between third riblet 176 and fourth riblet 178, and so on. In examples, groove 184, 186, 188 and other grooves defined by riblets 154 may substantially define a trough between two of riblets 154, with the trough having a depth (e.g., in the X-Y) plane substantially equal to height H. In examples, riblets 154 and/or grooves 181 may act to assist in maintaining fluid streamlines in proximity to shroud inner surface 152 as impeller 108 accelerates a fluid flowing through fluid channel 158. Riblets 154 and/or grooves 181 may act to reduce and/or mitigate pressure fluctuations, flow reversals, and/or other unsteady flow phenomena as impeller 108 accelerates the fluid flowing through fluid channel 158. Riblets 154 may define any number of grooves in grooves 181. Other grooves of grooves 181 may be configured similarly to groove 184, 186, 188.

In some examples, riblets 154 may be substantially an integrated portion of shroud body 121, such that riblets 154 and shroud body 154 form a unitary component. For example, in some examples, shroud 120 may be an additively manufactured component (e.g., 3-D printed). Shroud 120 may be fabricated using the additive manufacturing process to form and/or define riblets 154 and shroud body 154 such that riblets 154 and shroud body 154 are substantially uniform.

In some examples, shroud inner surface 152 defines a plane curve PC (e.g., a curve in the X-Y plane) which passing through at least some portion of riblets 154 (e.g., passes through at least riblets 173, 175, 176, 178). In examples, plane curve PC passes through at least riblets 173, 175, 176, 178 between a first end of each riblet (e.g., first end 180 of first riblet 173) and a second end of the each riblet (e.g., second end 182 of first riblet 173). Shroud inner surface 152 may be configured to substantially undulate across plane curve PC as shroud inner surface 152 defines riblets 173, 175. 176, 178 and/or other riblets of riblet 154. For example, shroud inner surface 152 may substantially define a corrugated surface defining, for example, a trough-to-crest height of height H.

In some examples, an individual riblet and an immediately adjacent riblet may define a width W (e.g., perpendicular to height H) between a first end of the individual riblet and a first end of the immediately adjacent. For example, first riblet 173 and its immediately adjacent second riblet 175 may define width W between riblet first end 180 and a first end 183 of second riblet 175. Similarly, second riblet 173 and third riblet 176, and third riblet 176 and fourth riblet 178, may further define width W between riblet first end 180 and a first end 183 of second riblet 175. In some examples, width W is less than about 5 millimeters (mm), in some examples less than about 1 mm, and in some examples less than about 0.5 mm. In examples, the riblet immediately adjacent to the individual riblet means a riblet that is first intersected by a vector normal originating on a surface of the individual riblet and parallel to the width W, perpendicular to height H, and/or parallel to the X axis of FIG. 4.

In examples, each of riblets 154 may define a height displacement between a first end of the each riblet and a second end of the each riblet substantially equal to height H. For example, the height defined by the each riblet may be at least 70% of height H in some examples, and at least 85% of height H in some examples. Each of riblets 154 may define a width displacement between a first end of the each riblet and a first end of its immediately adjacent riblet substantially equal to width W. For example, the width displacement defined by first end of the each riblet and a first end of its immediately adjacent riblet may be at least 70% of width W in some examples, and at least 85% of width W in some examples.

Hence, riblets 154 may comprise a group of substantially uniform riblets defined by shroud inner surface 152. Riblets 154 may include any number of riblets. In some examples, riblets 154 includes at least 10 riblets, in some examples at least 50 riblets, in some examples at least 100 riblets, and in some examples more than 100 riblets. However, riblets 154 may include any number of riblets. In some examples, riblets 154 are defined by shroud inner surface 152 over substantially an entirety of a portion of shroud inner surface 152 extending from first vane 140 to second vane 142, and/or extending between third vane 162 and fourth vane 164, and/or extending between an individual vane of vanes 138 and a vane immediately adjacent to the individual vane. In examples, the vane immediately adjacent to the individual vane means a vane that is first intersected by a vector originating at a surface defined by the individual vane, with the vector normal to the surface defined by the individual vane.

Riblets 173, 175, 176, 178 may be configured to extend along shroud inner surface 152 (FIG. 2) between first vane 140 and second vane 142. In examples, riblets 173, 175, 176, 178 extend between first vane and second vane 142 over at least some portion of shroud inner surface 152 between channel inlet 149 and outlet 150. In some examples, riblets 173, 175, 176, 178 extend at least from channel inlet 149 (e.g., as depicted by riblets entry portion 151) to outlet 150 (e.g., as depicted by riblets outlet portion 153). In examples, riblets 173, 175, 176, 178 may extend substantially from eye 124 to one of outlets 126 (e.g., outlet 150).

In some examples, at least some portion of riblets 154 (e.g., first riblet 173, second riblet 175, third riblet 176, fourth riblet 178) may be configured such that each riblet in the portion defines a line of curvature on shroud inner surface 152 which is non-intersecting with a line of curvature on shroud inner surface 152 defined by any other riblet of the portion of riblets. For example, first riblet 173 may define a first line of curvature which is non-intersecting with any line of curvature defined by riblet 175, 176, 178, second riblet 175 may define a second line of curvature which is non-intersecting with any line of curvature defined by riblet 173, 176, 178, third riblet 176 may define a line of curvature which is non-intersecting with any line of curvature defined by riblet 173, 175, 178, fourth riblet 178 may define a line of curvature which is non-intersecting with any line of curvature defined by riblet 173, 175, 176, and so on.

In examples, groove 184, 186, 188 extends over shroud inner surface 152 between first vane 140 and second vane 142. For example, groove 184, 186, 188 may extend between first vane and second vane 142 over at least some portion of shroud inner surface 152 between channel inlet 149 and outlet 150. In some examples, groove 184, 186, 188 extends at least from channel inlet 149 to outlet 150. In examples, groove 184, 186, 188 may extend substantially from eye 124 to outlet 150.

Figure 5:
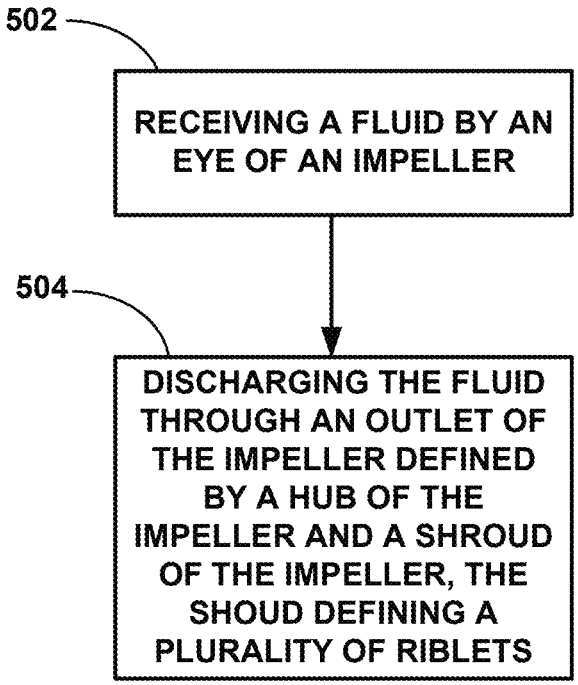
FIG. 5 is a flow diagram illustrating an example method of compressing a fluid using an impeller.

FIG. 5 illustrates a flow diagram of an example technique for compressing a fluid. Although the technique is described with reference to impeller 108 and/or VCS 104 (FIGS. 1-6), in other examples, the technique may be used with other components and/or systems.

The technique includes receiving, by an eye 124 of an impeller 108, a fluid (502). Impeller 108 may rotate about an axis L defined by impeller 108 as eye 124 receives the fluid. In examples, impeller 108 receives a torque T from a shaft 168, and torque T causes impeller 108 to rotate about axis L. In examples, eye 124 is defined by a shroud 120 and a hub 122 of impeller 108. Impeller 108 may accelerate the fluid as the fluid flows through a fluid channel 158 defined by shroud 120, hub 122, and two or more vanes of vanes 138 (e.g., first vane 140 and second vane 142).

Impeller 108 may discharge the fluid through one or more of outlets 126 (e.g., outlet 150) (504). In examples, at least some portion of the fluid received via eye 124 flows into channel inlet 149. Impeller 108 may cause acceleration of the portion of the fluid as impeller 108 rotates and the fluid flows through fluid channel 158 from channel inlet 149 to outlet 150.

Shroud 120 at least partially defines fluid channel 158 using a shroud inner surface 152. Hub 122 may at least partially define fluid channel 158 using a hub outer surface 156 (e.g., defined by a hub body 147). Impeller 108 may cause the fluid flowing through fluid channel 158 to fluidically couple with riblets 154 defined by shroud inner surface 152. In examples, impeller 108 causes the fluid flowing through fluid channel 158 to fluidically couple with riblets 154 as impeller 108 rotates about axis L.

Impeller 108 may accelerate and add fluid kinetic energy to the fluid flowing through fluid channel 158 as impeller 108 rotates about axis L. In examples, the accelerated fluid is decelerated in a diffuser (e.g., a diffuser portion of impeller 108 and/or compressor 106) to convert at least some portion of the fluid kinetic energy to a fluid potential energy, causing a static pressure increase of the fluid. In some examples, compressor 106 causes a first compression of the fluid using impeller 108 as a first compression stage and causes a second compression of the fluid using a second impeller 198 as a second compression stage. Compressor 106 may fluidically couple impeller 108 and second impeller 198, such that compressor 106 acts as a multi-stage compressor.

Impeller 108 may receive the fluid via eye 124 and cause fluid to flow through a plurality of fluid channels 157 defined at least in part by vanes 138. A portion of the fluid may flow through one of the plurality of fluid channels 157 from substantially from eye 124 to one of outlets 126. Impeller 108 may accelerate the fluid using each of the plurality of fluid channels 157 and eject the fluid from outlets 126. In examples, impeller 108 receives the fluid via eye 124 in an axial direction and discharges the fluid via outlets 126 in a direction substantially perpendicular to the axial direction.

In examples, impeller 108 is a portion of a compressor 106 of a system 100 including VCS 104. VCS 104 may cause a transfer of heat from a first location in thermal communication with an evaporator 114 to a second location in the thermal communication with a condenser 110. VCS 104 may fluidically couple compressor 106, condenser 110, an expansion device 112, and an evaporator 114 in a refrigerant circuit to transfer the heat. In examples, evaporator 114 is in thermal communication with cabin/systems 116 of a vehicle and condenser 110 is in thermal communication with a ram air system 130 of the vehicle. Compressor 106 may receive a vapor phase refrigerant from evaporator 114 and compress the vapor phase refrigerant. Compressor 106 may transfer the compressed refrigerant to condenser 110. In examples, a control system 132 for controls various conditions of VCS 104, such as refrigerant flow rate, refrigerant vapor composition, refrigerant temperature, and the like, as VCS 104 transfers the heat from the first location to the second location.

Control system 132 may monitor and/or operate one or more process control components, such as an air supply system 125, a ram air system 130, compressor 106, expansion device 112, or any other component of system 100. In examples, control system 132 receives measurement signals for various parameters of VCS 104, such as a speed of compressor 106, a temperature of cabin air leaving evaporator 114, or a superheat of vapor refrigerant entering compressor 106, determines a mismatch between the measurement signals and a setpoint for the corresponding parameter, and sends a control signal to one or more components of system 100 to reduce the mismatch and return the parameter to within the setpoint. In examples, control system 132 monitors and/or operates the one or more process control components using a motor controller 128, a vapor controller 134, a pressure/flow controller 136, and/or other control systems configured to operate the one or more process control components.

The disclosure includes the following examples.

Example 1: An impeller for a compressor configured to compress a fluid, the impeller comprising: a shroud; a hub, wherein the shroud and the hub define an eye configured to receive the fluid and define an outlet configured to discharge the fluid, and wherein the shroud includes a shroud inner surface facing the hub; and at least a first vane and a second vane, the first vane and the second vane extending from the hub and toward the shroud and extending from the eye to the outlet, wherein the shroud inner surface defines a plurality of riblets extending toward the hub, the plurality of riblets extending in a direction from the eye toward the outlet.

Example 2: The impeller of example 1, wherein the eye is configured to receive the fluid when the fluid flows in an axial direction, and the outlet is configured to discharge the fluid in a radial direction substantially perpendicular to the axial direction.

Example 3: The impeller of example 1 or 2, wherein the first vane and the second vane are affixed to the hub and affixed to the shroud.

Example 4: The impeller of any of examples 1-3, wherein the hub includes a hub outer surface facing the shroud inner surface, and wherein the first vane, the second vane, the shroud inner surface, and the hub outer surface define a channel fluidically coupling the eye and the outlet.

Example 5: The impeller of any of examples 1-4, wherein the hub outer surface, the shroud inner surface, the first vane, and the second vane are configured to cause an acceleration of the fluid when the eye receives the fluid, the fluid flows from the eye to the outlet, and the impeller rotates about an axis defined by the impeller.

Example 6: The impeller of example 4 or example 5, wherein the hub outer surface surrounds an axis defined by the impeller, and wherein the shroud inner surface surrounds the hub outer surface.

Example 7: The impeller of example 6, wherein the hub defines a recess configured to receive a shaft to cause rotation of the impeller about the axis, wherein the axis extends into the recess.

Example 8: The impeller of any of examples 4-7, wherein the shroud inner surface and the hub outer surface define a displacement between the shroud inner surface and the hub outer surface from the eye to the outlet, and wherein the first vane and the second vane extend across the displacement.

Example 9: The impeller of any of examples 4-8, wherein the impeller includes a plurality of vanes, the plurality of vanes including the first vane, the second vane, and an additional group of vanes, each vane in the additional group of vanes extending between the hub and the shroud and extending from the eye to the outlet, wherein each vane of the additional group of vanes at least partially defines an additional channel fluidically coupling the eye and an additional outlet defined by the hub and the shroud, and wherein a portion of the shroud inner surface defining the additional channel defines an additional plurality of riblets extending toward the hub outer surface, the additional plurality of riblets extending from the eye to the additional outlet.

Example 10: The impeller of any of examples 1-9, wherein a first riblet in the plurality of riblets defines a first line of curvature on the shroud inner surface and a second riblet in the plurality of riblets defines a second line of curvature on the shroud inner surface, wherein the first line of curvature is non-intersecting with the second line of curvature.

Example 11: The impeller of any of examples 1-10, wherein each riblet in the plurality of riblets is an additively manufactured riblet which is contiguous with a body of the shroud.

Example 12: The impeller of any of examples 1-11, wherein each riblet in the plurality of riblets extends over a portion of the shroud inner surface extending between the first vane and the second vane.

Example 13: The impeller of any of examples 1-12, further comprising a housing defining a fluid inlet fluidically coupled to the outlet, wherein the impeller is configured to rotate relative to the housing about an axis defined by the impeller, and wherein the first vane and the second vane are configured to impart a velocity to the fluid received by the eye when the impeller rotates relative to the housing.

Example 14: The impeller of example 13, further comprising a second impeller including a second shroud and a second hub, the second shroud and the second hub defining a second eye configured to receive the fluid and defining a second outlet configured to discharge the fluid, and the second impeller including a plurality of vanes extending from the second eye to the second outlet, wherein the second impeller is configured to rotate relative to the housing, and wherein the housing is configured to direct the fluid from the outlet of the impeller to the second eye of the second impeller.

Example 15: The impeller of any of examples 1-14, wherein one or more riblets define a height of less than or equal to about 1 millimeter.

Example 16: An impeller for a compressor configured to compress a fluid, the impeller comprising: a shroud; a hub, wherein the shroud and the hub define an eye configured to receive the fluid and define an outlet configured to discharge the fluid, wherein the eye is configured to receive the fluid when the fluid flows in an axial direction and the outlet is configured to discharge the fluid in a radial direction substantially perpendicular to the axial direction, and wherein the shroud includes a shroud inner surface facing the hub; and at least a first vane and a second vane, wherein the first vane and the second vane extend from the hub and toward the shroud inner surface and extend from the eye to the outlet, wherein the first vane and the second vane are affixed to the hub and affixed to the shroud inner surface, and wherein the shroud inner surface defines a plurality of riblets extending toward the hub, the plurality of riblets extending in a direction from the eye toward the outlet.

Example 17: The impeller of example 16, wherein one or more riblets define a height of less than or equal to about 1 millimeter.

Example 18: The impeller of example 16 of example 17, wherein the shroud inner surface defines the plurality of riblets at least with a portion of the shroud inner surface between the first vane and the second vane, and wherein the plurality of riblets extend over the portion of the shroud inner surface between the first vane and the second vane.

Example 19: A method, comprising: receiving, using an impeller, a fluid within an eye of the impeller defined by a shroud of the impeller and a hub of the impeller, wherein the shroud and the hub defines an outlet, wherein the shroud includes a shroud inner surface facing the hub, and wherein the impeller includes at least a first vane and a second vane, the first vane and the second vane extending from the hub and toward the shroud and extending from the eye to the outlet; and, discharging, using the impeller, the fluid from the outlet, wherein the shroud inner surface defines a plurality of riblets extending toward the hub, the plurality of riblets defining a plurality of grooves extending in a direction from the eye toward the outlet.

Example 20: The method of example 19, further comprising accelerating the fluid as the fluid flows from the eye to the outlet and the impeller rotates about an axis defined by the impeller.

Various examples have been described. These and other examples are within the scope of the following claims.

What is claimed is:

1. An impeller for a compressor configured to compress a fluid, the impeller extending along an axis and comprising:

a shroud;

a hub, wherein the shroud and the hub define an eye configured to receive the fluid and define an outlet configured to discharge the fluid, and wherein the shroud includes a shroud radially inner-most surface facing the hub;

at least a first vane and a second vane, the first vane and the second vane extending from the hub and toward the shroud and extending from the eye to the outlet; and a plurality of riblets extending from the shroud radially inner-most surface toward the hub, each riblet of the plurality of riblets extending in a direction from the eye toward the outlet at a non-orthogonal angle relative to the axis, wherein adjacent riblets of the plurality of riblets are separated by a groove, the groove extending along the shroud radially inner-most surface.

2. The impeller of claim 1, wherein the eye is configured to receive the fluid when the fluid flows in an axial direction, and the outlet is configured to discharge the fluid in a radial direction substantially perpendicular to the axial direction.

3. The impeller of claim 1, wherein the first vane and the second vane are affixed to the hub and affixed to the shroud.

4. The impeller of claim 1, wherein the hub includes a hub outer surface facing the shroud radially inner-most surface, and wherein the first vane, the second vane, the shroud radially inner-most surface, and the hub outer surface define a channel fluidically coupling the eye and the outlet.

5. The impeller of claim 4, wherein the hub outer surface, the shroud radially inner-most surface, the first vane, and the second vane are configured to cause an acceleration of the fluid when the eye receives the fluid, the fluid flows from the eye to the outlet, and the impeller rotates about the axis.

6. The impeller of claim 4, wherein the hub outer surface surrounds the axis, and wherein the shroud radially inner-most surface surrounds the hub outer surface.

7. The impeller of claim 6, wherein the hub defines a recess configured to receive a shaft to cause rotation of the impeller about the axis, wherein the axis extends into the recess.

8. The impeller of claim 4, wherein the shroud radially inner-most surface and the hub outer surface define a displacement between the shroud radially inner-most surface and the hub outer surface from the eye to the outlet, and wherein the first vane and the second vane extend across the displacement.

9. The impeller of claim 4, wherein the impeller includes a plurality of vanes, the plurality of vanes including the first vane, the second vane, and an additional group of vanes, each vane in the additional group of vanes extending between the hub and the shroud and extending from the eye to the outlet, wherein each vane of the additional group of vanes at least partially defines an additional channel fluidically coupling the eye and an additional outlet defined by the hub and the shroud, and wherein an additional plurality of riblets extends from shroud radially inner-most surface toward the hub outer surface, each riblet of the additional plurality of riblets extending from the eye to the additional outlet at a non-orthogonal angle relative to the axis.

10. The impeller of claim 1, wherein a first riblet in the plurality of riblets defines a first line of curvature on the shroud inner surface and a second riblet in the plurality of riblets defines a second line of curvature on the shroud inner surface, wherein the first line of curvature is non-intersecting with the second line of curvature.

11. The impeller of claim 1, wherein each riblet in the plurality of riblets is an additively manufactured riblet which is contiguous with a body of the shroud.

12. The impeller of claim 1, wherein each riblet in the plurality of riblets extends over a portion of the shroud radially inner-most surface extending between the first vane and the second vane.

13. The impeller of claim 1, further comprising a housing defining a fluid inlet fluidically coupled to the outlet, wherein the impeller is configured to rotate relative to the housing about the axis, and wherein the first vane and the second vane are configured to impart a velocity to the fluid received by the eye when the impeller rotates relative to the housing.

14. The impeller of claim 13, further comprising a second impeller including a second shroud and a second hub, the second shroud and the second hub defining a second eye configured to receive the fluid and defining a second outlet configured to discharge the fluid, and the second impeller including a plurality of vanes extending from the second eye to the second outlet, wherein the second impeller is configured to rotate relative to the housing, and wherein the housing is configured to direct the fluid from the outlet of the impeller to the second eye of the second impeller.

15. The impeller of claim 1, wherein one or more riblets define a height of less than or equal to about 1 millimeter.

16. An impeller for a compressor configured to compress a fluid, the impeller extending along an axis and comprising:

a shroud;

a hub, wherein the shroud and the hub define an eye configured to receive the fluid and define an outlet configured to discharge the fluid, wherein the eye is configured to receive the fluid when the fluid flows in an axial direction and the outlet is configured to discharge the fluid in a radial direction substantially perpendicular to the axial direction, and wherein the shroud includes a shroud radially inner-most surface facing the hub;

at least a first vane and a second vane, wherein the first vane and the second vane extend from the hub and toward the shroud radially most inner surface and extend from the eye to the outlet, wherein the first vane and the second vane are affixed to the hub and affixed to the shroud radially most inner surface; and a plurality of riblets extending from the shroud radially inner-most surface toward the hub, each riblet of the plurality of riblets extending in a direction from the eye toward the outlet at a non-orthogonal angle relative to the axis, and wherein adjacent riblets of the plurality of riblets are separated by a groove, the groove extending along the shroud radially inner-most surface.

17. The impeller of claim 16, wherein one or more riblets define a height of less than or equal to about 1 millimeter.

18. The impeller of claim 16, wherein the shroud radially inner-most surface defines the plurality of riblets at least with a portion of the shroud inner surface between the first vane and the second vane, and wherein the plurality of riblets extend over the portion of the shroud inner surface between the first vane and the second vane.

19. A method, comprising:

receiving, using an impeller, a fluid within an eye of the impeller defined by a shroud of the impeller and a hub of the impeller, wherein the impeller extends along an axis, wherein the shroud and the hub defines an outlet, wherein the shroud includes a shroud radially inner-most surface facing the hub, and wherein the impeller includes at least a first vane and a second vane, the first vane and the second vane extending from the hub and toward the shroud radially inner-most surface and extending from the eye to the outlet; and discharging, using the impeller, the fluid from the outlet, wherein the impeller further comprises a plurality of riblets extending from the shroud radially inner-most surface toward the hub, the plurality of riblets defining a plurality of grooves extending in a direction from the eye toward the outlet at a non-orthogonal angle relative to the axis along the shroud radially inner-most surface, wherein adjacent riblets of the plurality of riblets are separated by a groove of the plurality of grooves.

20. The method of claim 19, further comprising accelerating the fluid as the fluid flows from the eye to the outlet and the impeller rotates about the axis.

* * * * *